US010470589B1

(12) United States Patent
Huynh

(10) Patent No.: US 10,470,589 B1
(45) Date of Patent: Nov. 12, 2019

(54) DISPLAY RACK ASSEMBLIES

(71) Applicant: Linh Nhat Huynh, Shreveport, LA (US)

(72) Inventor: Linh Nhat Huynh, Shreveport, LA (US)

( * ) Notice: Subject to any disclaimer, the term of this patent is extended or adjusted under 35 U.S.C. 154(b) by 0 days.

(21) Appl. No.: 16/373,141

(22) Filed: Apr. 2, 2019

(51) Int. Cl.

| | |
|---|---|
| ***A47F 5/00*** | (2006.01) |
| ***A47F 5/10*** | (2006.01) |
| ***A47F 5/02*** | (2006.01) |
| ***A47F 7/14*** | (2006.01) |
| ***A47F 11/10*** | (2006.01) |

(52) U.S. Cl.
CPC ..... *A47F 5/0087* (2013.01); *A47F 5/0018* (2013.01); *A47F 5/02* (2013.01); *A47F 5/10* (2013.01); *A47F 7/147* (2013.01); *A47F 11/10* (2013.01)

(58) Field of Classification Search
CPC ..... A47F 5/0087; A47F 5/0018; A47F 5/02; A47F 5/10; A47F 11/10; A47F 7/0246; A47F 5/04; A47F 5/05; A47F 5/025; A47F 3/10; A47F 7/146; A47F 7/144; A47F 7/147; A47F 7/163; A47F 3/11; A47F 5/0037; A47F 5/0081; A47F 5/16; A47B 49/00; A47B 49/004
USPC ..... 211/144, 150, 163, 165, 47, 48, 131.1, 211/129.1, 133.4, 95, 96; 108/99, 95, 108/139
See application file for complete search history.

(56) References Cited

U.S. PATENT DOCUMENTS

| | | | | | |
|---|---|---|---|---|---|
| 832,601 | A * | 10/1906 | Fisk | B65H 49/32 | 211/162 |
| 1,049,886 | A * | 1/1913 | Manson | G09F 11/02 | 211/169 |
| 1,141,274 | A * | 6/1915 | Skall | A47B 67/02 | 211/165 |
| 1,381,525 | A * | 6/1921 | Wagoner | A47B 81/067 | 211/169 |
| 1,421,391 | A | 7/1922 | Bower | | |
| 1,562,975 | A * | 11/1925 | Leake | A47C 21/02 | 211/165 |
| 1,569,365 | A * | 1/1926 | Goldberg | A47F 5/05 | 211/135 |
| 1,740,118 | A * | 12/1929 | Rand | B42F 17/28 | 40/379 |
| 1,766,940 | A * | 6/1930 | Powell | B42F 17/28 | 40/379 |
| 1,789,839 | A * | 1/1931 | Powell | B42F 17/28 | 40/379 |
| 2,220,189 | A * | 11/1940 | Wolters | B42F 17/28 | 211/169 |
| 2,690,843 | A * | 10/1954 | Ament | A47F 5/02 | 211/165 |

(Continued)

*Primary Examiner* — Jennifer E. Novosad
(74) *Attorney, Agent, or Firm* — R. Keith Harrison

(57) ABSTRACT

Display rack assemblies suitable for displaying merchandise containers of nail polish, cosmetics and the like in a highly visible and accessible manner may include an assembly frame having an assembly base and an assembly cap on the assembly base. At least one display rack may be releasably and pivotally deployed between the assembly base and the assembly cap of the assembly frame. The at least one display rack may have a plurality of rack shelves for supporting merchandise containers.

19 Claims, 14 Drawing Sheets

(56) References Cited

U.S. PATENT DOCUMENTS 2,923,417 A * 2/1960 Sonksen ..... A47F 5/05 211/165
3,181,706 A * 5/1965 Mandel ..... A47F 5/05 211/163
3,195,736 A * 7/1965 Bomar, Jr. ..... A47F 5/05 211/163
3,478,893 A * 11/1969 Crosslen ..... A47F 5/05 211/165
3,565,260 A * 2/1971 Stewart ..... A47F 5/00 211/4
3,625,368 A * 12/1971 Toms ..... A47F 7/14 211/169
3,661,273 A * 5/1972 Crosslen ..... A47F 5/02 211/163
3,722,699 A * 3/1973 Crosslen ..... A47F 5/02 211/169
3,760,952 A 9/1973 White
3,820,862 A * 6/1974 Crosslen ..... A47F 5/0087 312/117
3,844,230 A * 10/1974 Hudson ..... A47F 5/02 108/103
3,924,749 A * 12/1975 Weston ..... A47F 5/04 211/169
3,960,273 A * 6/1976 Weston ..... A47F 7/0246 211/4
4,102,069 A * 7/1978 Eckert ..... A47F 5/02 211/169
4,270,290 A * 6/1981 Eckert ..... A47F 5/02 211/169
4,528,914 A * 7/1985 Montet ..... A47B 49/00 108/60
5,090,648 A * 2/1992 Wood, IV ..... B05B 13/0228 248/125.3
5,164,011 A * 11/1992 Ray ..... B05B 13/0285 118/500
5,226,548 A * 7/1993 Koeppel ..... A47F 5/02 211/144
5,259,515 A * 11/1993 Koeppel ..... A47B 81/068 211/163
5,280,840 A * 1/1994 Terpening ..... A47F 5/02 211/165
5,285,910 A * 2/1994 Chen ..... B65G 1/133 211/122
5,735,414 A * 4/1998 Lo ..... A47G 25/0664 211/162
6,000,561 A 12/1999 Schumacher
D418,330 S * 1/2000 Schumacher ..... D6/679
6,205,616 B1 * 3/2001 Hwang ..... E05D 7/1011 16/229
6,237,782 B1 * 5/2001 Hunn ..... A47F 7/163 211/45
6,286,692 B1 * 9/2001 Hemping ..... A47F 7/00 206/325
6,523,700 B2 * 2/2003 Nadeau ..... A47F 7/146 211/40
6,702,130 B1 * 3/2004 Carlilse ..... B05B 13/0285 118/500
6,959,901 B2 * 11/2005 Chang ..... B42F 17/28 211/165
7,481,323 B2 * 1/2009 Fisher ..... B05B 13/0285 211/189
9,022,236 B1 * 5/2015 Amendolea ..... B65G 1/026 211/144

* cited by examiner

DISPLAY RACK ASSEMBLIES

FIELD

Illustrative embodiments of the disclosure generally relate to display racks suitable for displaying merchandise. More particularly, illustrative embodiments of the disclosure relate to display rack assemblies which are suitable for displaying, merchandise containers of nail polish, cosmetics and the like in a highly visible and accessible manner.

SUMMARY

Illustrative embodiments of the disclosure are generally directed to display rack assemblies which are suitable for displaying merchandise containers of nail polish, cosmetics and the like in a highly visible and accessible manner. An illustrative embodiment of the display rack assemblies may include an assenibly frame having an assembly base and an assenibly cap on the assembly base. At least one display rack may be releasably and pivotally deployed between the assembly base and the assembly cap of the assembly frame. The at least one display rack may have a plurality of rack shelves for supporting merchandise containers.

BRIEF DESCRIPTION OF THE DRAWINGS

Illustrative embodiments of the disclosure will no be described, by way of example, with reference to the accornpanying drawings, in which.

DETAILED DESCRIPTION

The following detailed description is merely exemplary n nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", "inner", and derivatives thereof shall relate to the invention as oriented in FIG. 9. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
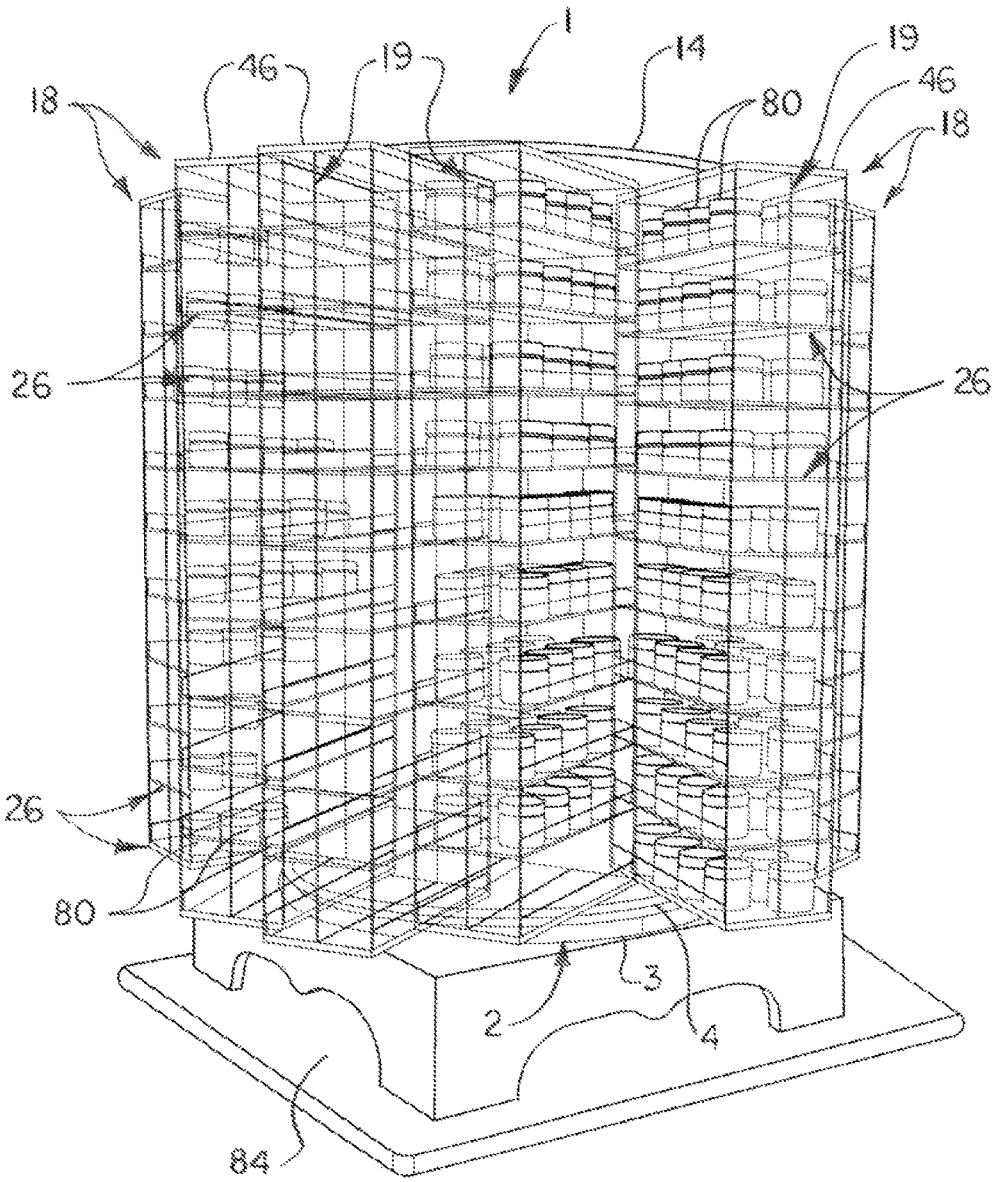
FIG. 1 is a front perspective view of an illustrative carousel embodiment of the display rack assemblies, with nuiltiple merchandise containers supported on display racks of the display rack assembly.

Referring initially to FIGS. 1-13 of the drawings, an illustrative carousel embodiment of the display rack assemblies, hereinafter display rack assembly, is generally indicated by reference numeral 1. As illustrated in FIG. 1 and will be hereinafter further described, in typical application, the display rack assembly 1 may be suitable for displaying merchandise containers 80 in a highly-visible and accessible manner. In some applications, the merchandise containers 80 may contain nail polish, cosmetics and the like. In other applications, the merchandise containers 80 may contain other types of merchandise. In some embodiments, the capacity of the display rack assembly 1 may be easily varied to accommodate selected quantities or numbers of the merchandise containers 80 depending on the needs of the user, typically in a manner which will be hereinafter described.

The display rack assembly 1 may include an assembly frame 12. At least one display rack 18 may be releasably and pivotally deployed in the assembly frame 12. The display racks 18 may be suitably sized and configured to support the merchandise containers $0 for access by a consumer.

The assembly frame 12 of the display rack assembly 1 may include an assembly base 2. The assembly base 2 may include a bottom base member 3 which may be flat and configured to rest on a flat support structure 84 or other surface (FIG. 1). A turntable 4 may be rotatably mounted on and with respect to the bottom base member 3 according to the knowledge of those skilled in the art.

Figure 2:
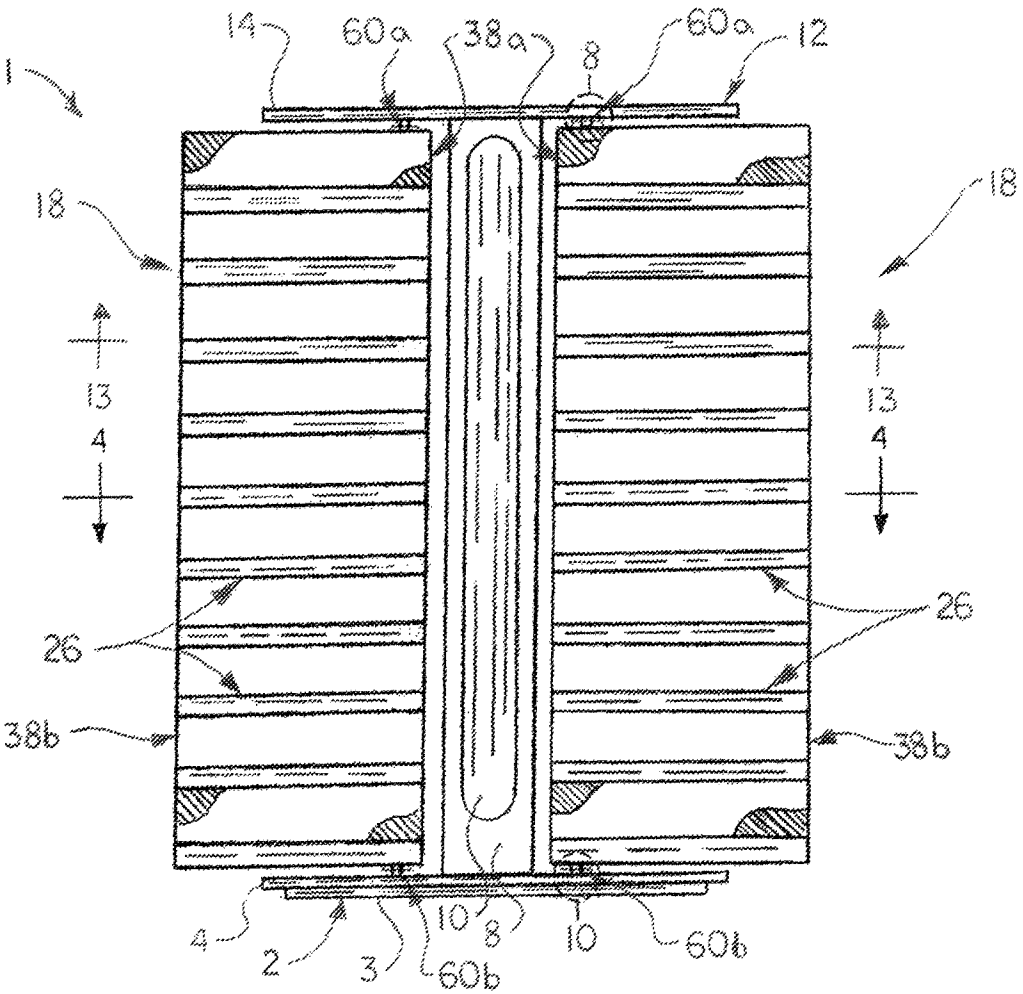
FIG. 2 is a front view of the illustrative display rack, assembly illustrated in FIG. 1, with the merchandise containers omitted from the display racks for clarity.
Figure 3:
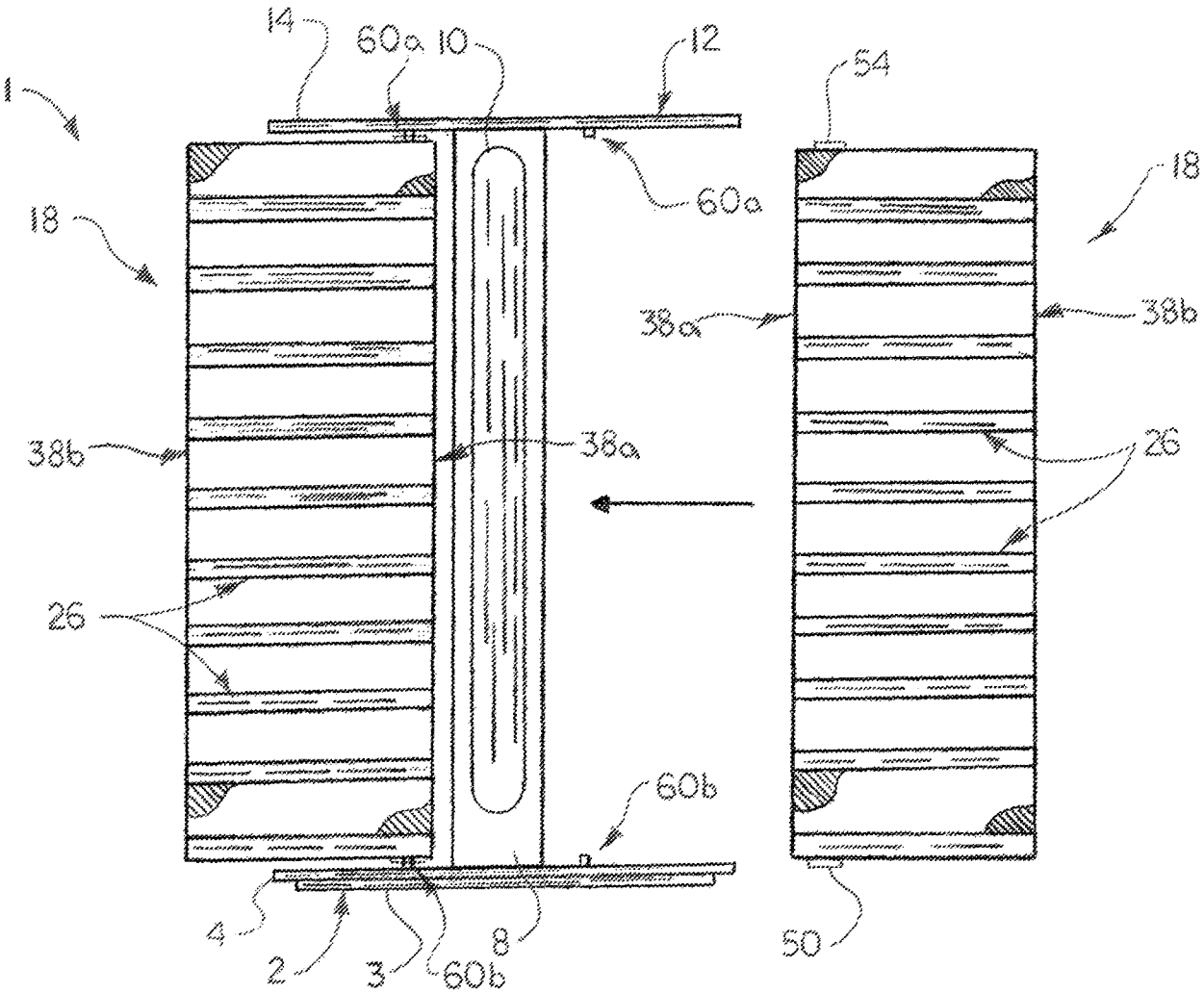
FIG. 3 is an exploded front view of the illustrative display rack assembly illustrated in FIG. 2, more particularly illustrating typical removability of each display rack with respect to an assembly frame of the display rack assembly.
Figure 4:
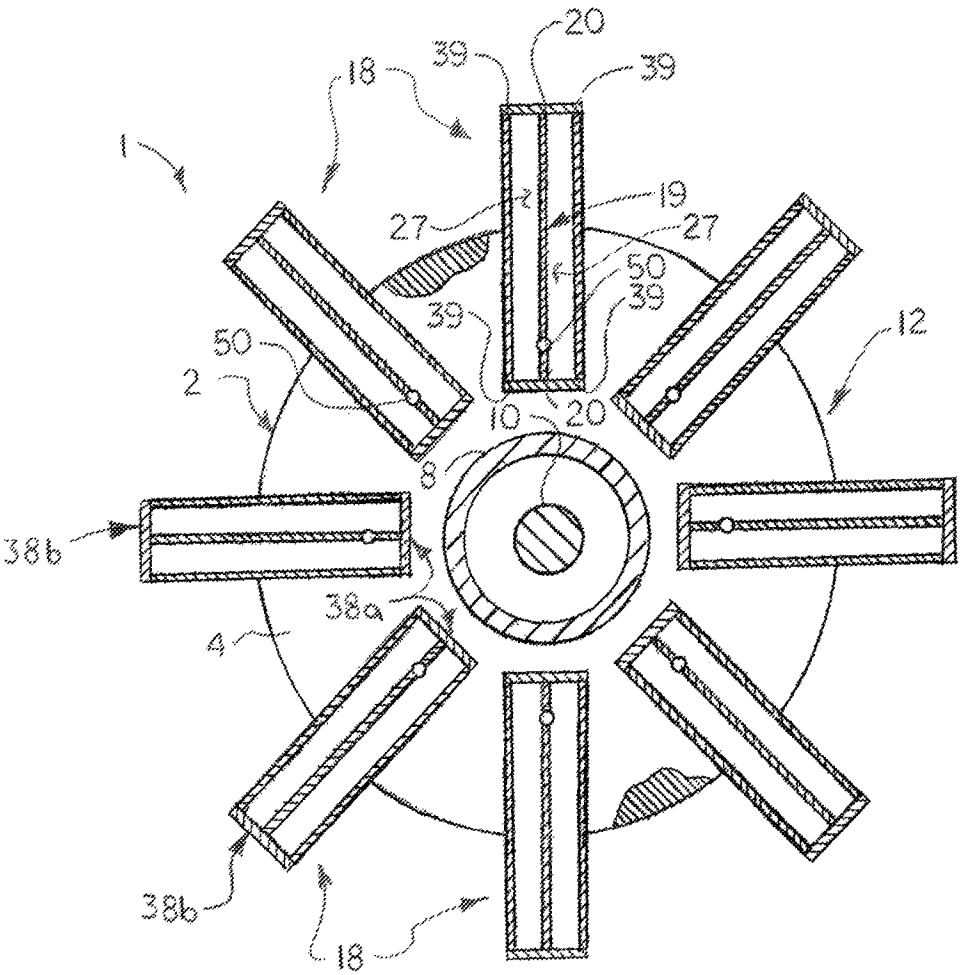
FIG. 4 is a top cross-sectional view, taken along section lines 4-4 in FIG. 2, of the illustrative display rack assembly.

An assembly cap 14 may be supported by the assembly base 2 above and in spaced-apart relationship thereto. In some eniboditnents, at least one assembly column 8 may extend upwardly from the assembly base 2, and the assembly cap 14 may be supported by the assembly column 8. As illustrated in FIGS. 2 and 3, in some embodiments, at least one assembly column 8 may extend from the turntable 4 of the assembly base 2, as illustrated. The assembly cap 14 may be provided on the assembly column 8. Accordingly, the assembly column 8 and assembly cap 14 may rotate with the turntable 4 as the turntable 4 rotates with respect to the bottom base member 3. As further illustrated in FIGS. 2 and 3, in some embodiments, at least one light 10 may be provided inside or on the assembly column 8 for illimtitiation purposes, as will be hereinafter described.

At least one display rack 18 may be pivotally deployed between the assembly base 2 and the assembly cap 14 of the assembly frame 12. In some embodiments, the display racks 18 may be releasably and pivotally deployed between the assembly base 2 and the assembly cap 14 typically as will be hereinafter described. The display racks 18 may be disposed in spaced-apart relationship to each other around the circumference of the turntable 4 and the assembly cap 14. As illustrated in FIG. 1, each display rack 18 may be configured to support multiple merchandise containers 80 in a highly visual and accessible manner.

Figure 5:
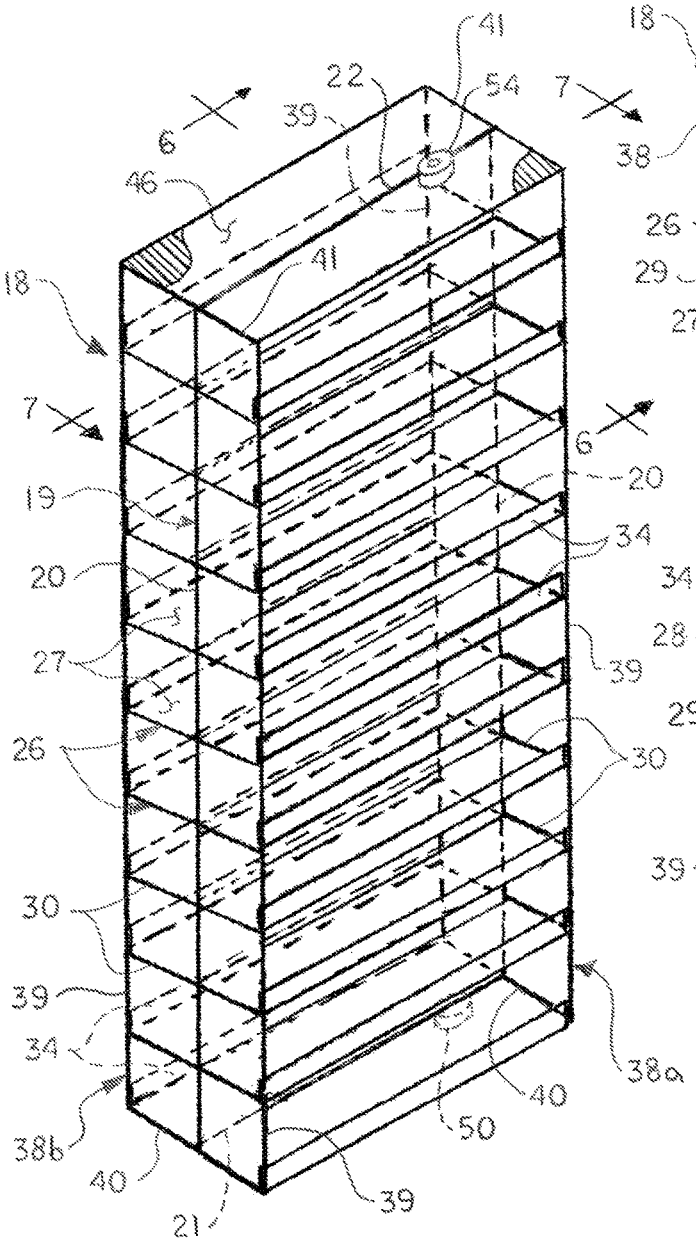
FIG. 5 is a front perspective view of a typical display rack of the display rack assembly.
Figure 6:
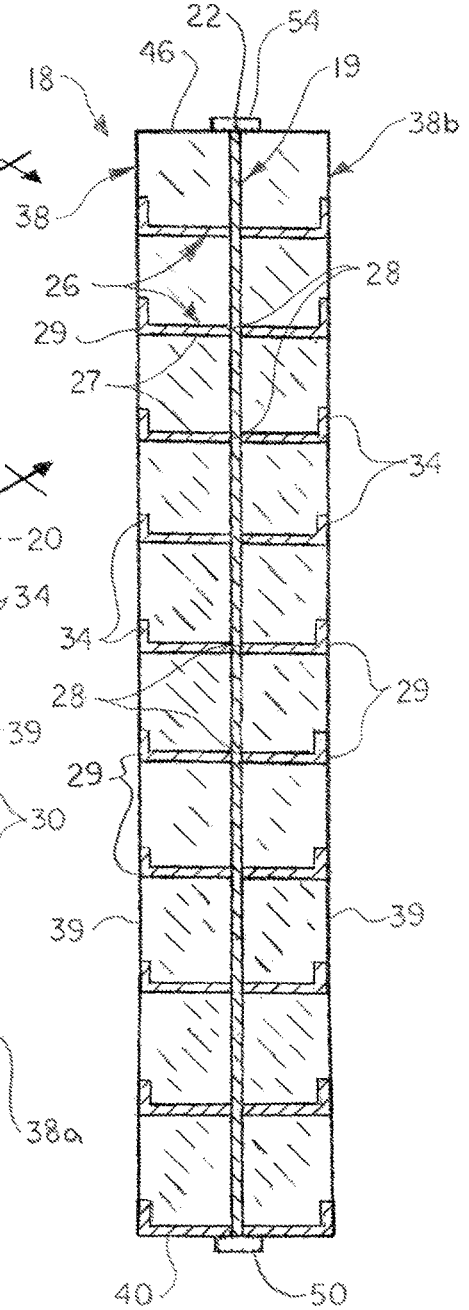
FIG. 6 is a longitudinal sectional view, taken along section lines 6-6 in FIG. 5, of the display rack.
Figure 7:
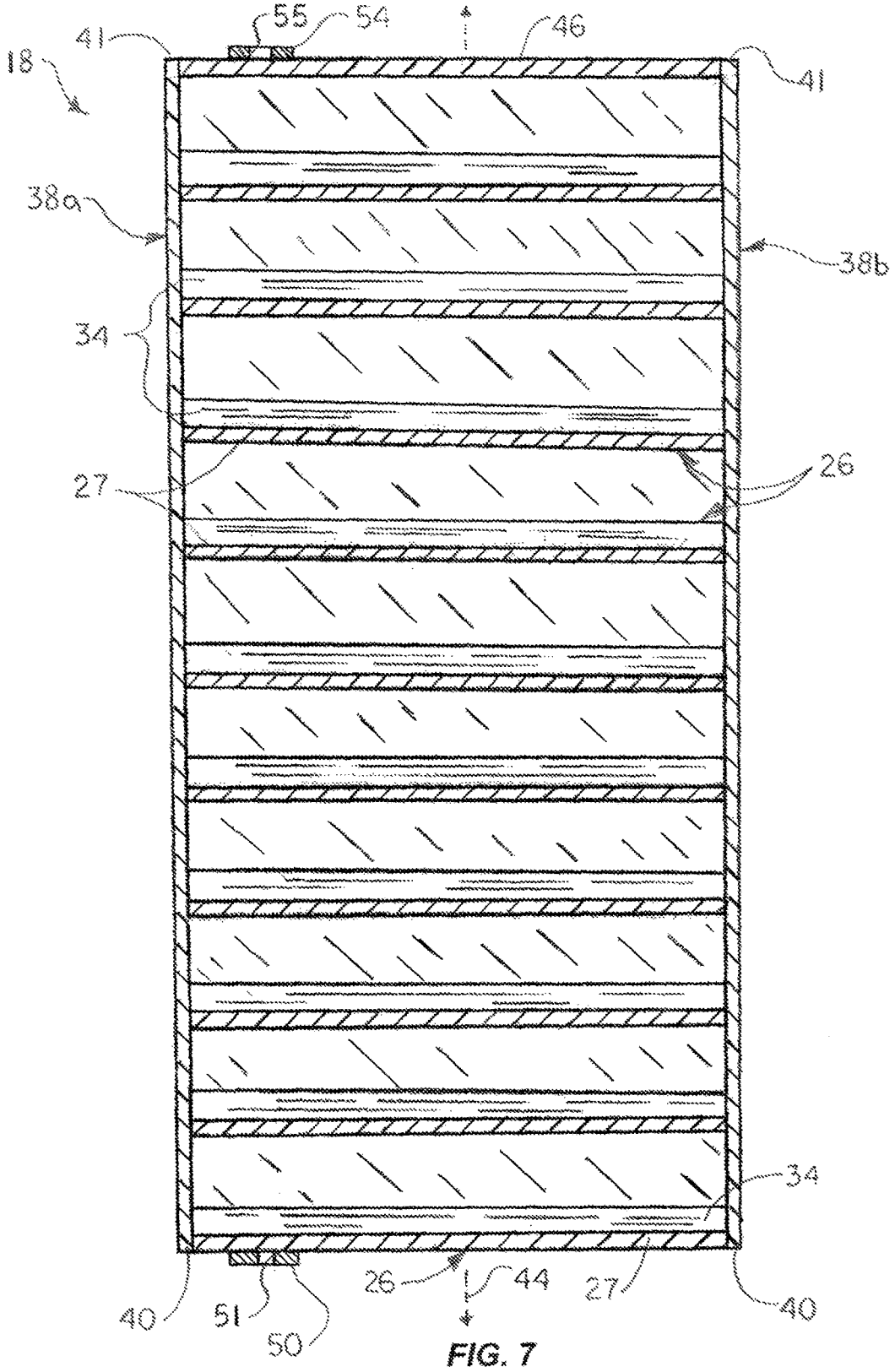
FIG. 7 is a longitudinal sectional view, taken along section lines 7-7 in FIG. 5, of the display rack.

In some embodiments, each display rack 18 may be fabricated of clear or transparent plastic or like material. As illustrated in FIGS. 5-7, each display rack 18 may have an elongated, rectangular, box-shaped configuration and may include an elongated pivot end rack panel 38*a* and an elongated swing end rack panel 38*b* disposed in parallel, spaced-apart relationship to each other. Each of the pivot end rack panel 38*a* and the swing, end rack panel 38*b* may be elongated and rectangular with a pair of elongated, parallel, spaced-apart side end panel edges 39. A lower end panel edge 40 and an upper end panel edge 41 may extend be the side end panel edges 39.

A center rack panel 19 may extend between the pivot end rack panel 38*a* and the swing end rack panel 38*b*. The center rack panel 19 may be elongated and rectangular with a pair of elongated, parallel, spaced-apart side rack panel edges 20. A bottom rack panel edge 21 and a top rack panel, edge 22 may extend between the side rack panel edges 20. The end rack panels 38*a*, 38*b* may be disposed in perpendicular relationship to and may engage the respective side rack panel edges 20 of the center rack panel 19, A top rack panel 46 may extend over the upper end panel edges 41 of the respective pivot end rack panel 38*a* and swing end rack panel 38*b* and the top rack panel edge 22 of the center rack panel 19. Accordingly, the top rack panel 46 may close the upper end of the display rack 18.

Multiple rack shelves 26 may extend between the pivot end rack panel 38*a* and the swing end rack panel 38*b* on respective sides of the center rack panel 19. The rack shelves 26 may be disposed in parallel, spaced-apart relationship to each other from the lower end panel edges 40 to the upper end panel edges 41 of the end rack panels 38*a*, 38*b* and from the bottom rack panel edge 21 to the top rack panel edge 22 of the center rack panel 19. Ihe rack shelves 26 may face outwardly in opposite directions from the center rack panel 19. In some embodiments, each rack shelf 26 may include a main shelf panel 27 which may be rectangular and planar. As illustrated in FIG. 6, each main shelf panel 27 may have a proximal shelf panel edge 28 which extends along a corresponding surface of the center rack panel 19. A distal shelf panel edge 29 may extend in parallel, spaced-apart relationship to the proximal shelf panel edge 28. As illustrated in FIG. 5, a pair of parallel, spaced-apart side shelf panel edges 30 may extend from the proximal shelf edge 28 to the distal shelf panel 29. The side shelf panel edges 30 may extend along the interior surfaces of the respective pivot enact track panel 38*a* and swing, end rack panel 38*b*. The distal shelf panel edge 29 of each main shelf panel 27 may terminate in flush relationship to a corresponding side end panel edge 39 of each corresponding end rack panel 38*a*, 38*b* on a corresponding side of the center rack panel 19.

An elongated shelf flange 34 may terminate the distal shelf panel edge each main shelf panel 27. The shelf flange 34 may be disposed in perpendicular relationship to the plane of the main shelf pant.l 27 and in parallel relationship to the plane of the center rack panel 19.

Figure 9:
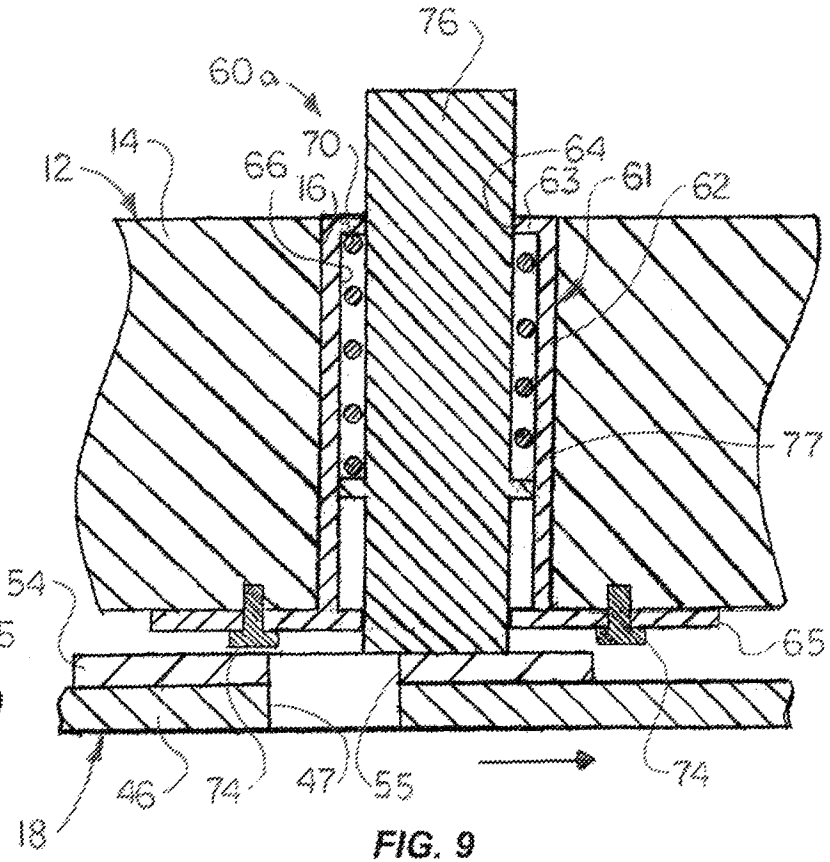
FIG. 9 is an enlarged sectional view, taken at section line 8 in FIG. 2, of the cap rack mounting assembly disposed in a release position.
Figure 8:
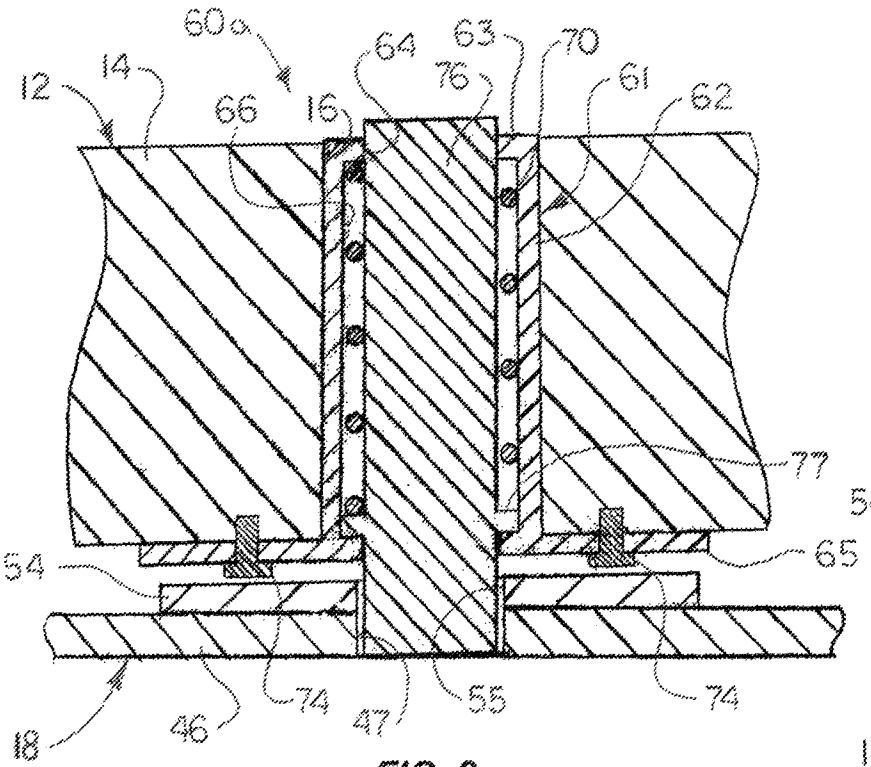
FIG. 8 is an enlarged sectional view, taken at section line 8 in FIG. 2, of a typical cap rack mounting assembly suitable for locking each display rack in the assembly frame, with the cap rack mounting assenthly disposed in a locking position.

At least one rack mounting assembly 60 may reieasably secure each display rack 18 to at least one of the assembly base 2 and the assembly cap 14 of the assembly frame 12. In some embodiments, a cap rack mounting assembly 60*a* may secure each display rack 18 to the assembly cap 14 and a base rack mounting assembly 60*b* may secure each display rack 18 to the assenibly base 2. As illustrated in FIGS. 8 and 9, in some embodiments, each cap rack mounting assembly 60*a* may include a pin housing 61. The pin housing 61 may have a cylindrical pin housing sidewall 62. A pin housing end wall 63 may extend from one end of the pin housing sidewall 62. A pin opening 64 may extend through the pin housing end wall 63. A pin housing interior 66 may be formed by and between the pin housing sidewall 62 and the pin housing end wall 63. A pin housing flange 65 may extend inwardly and outwardly from the pin housing sidewall 62 opposite the pin housing end wall 63.

Figure 10:
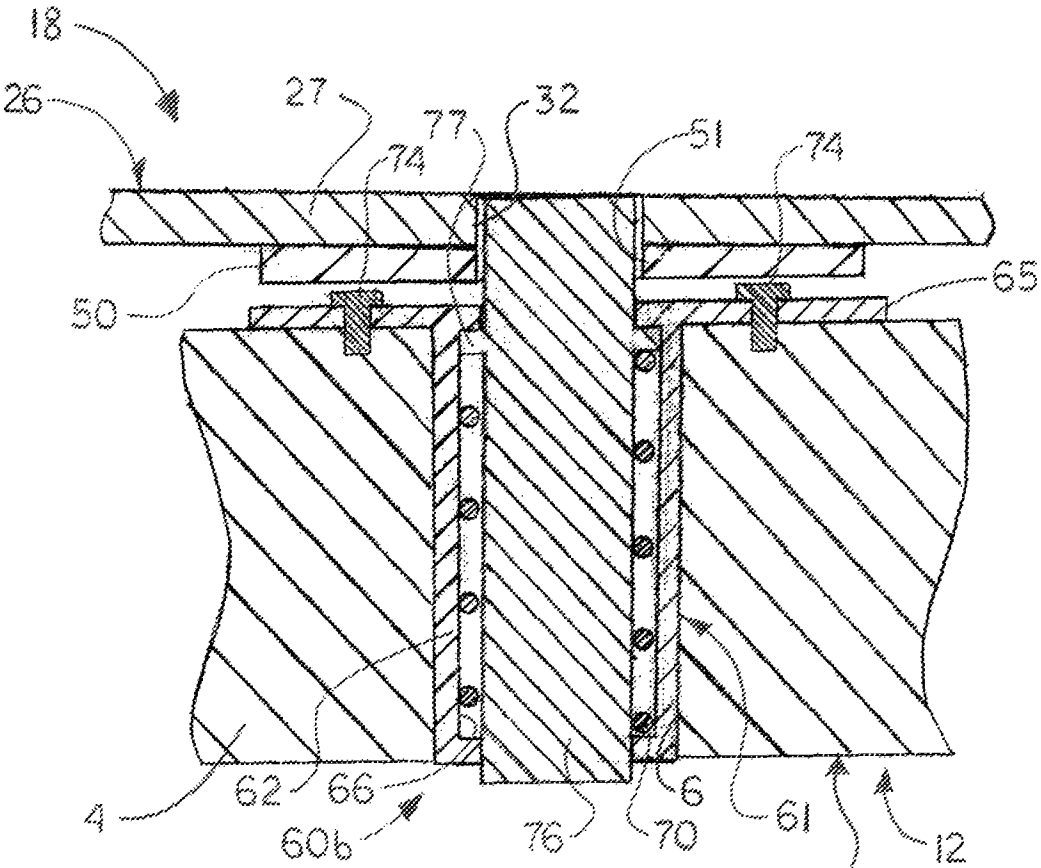
FIG. 10 is an enlarged sectional view illustrating a typical lower rack mounting assembly disposed in the locking position on the assembly tiame.
Figure 13:
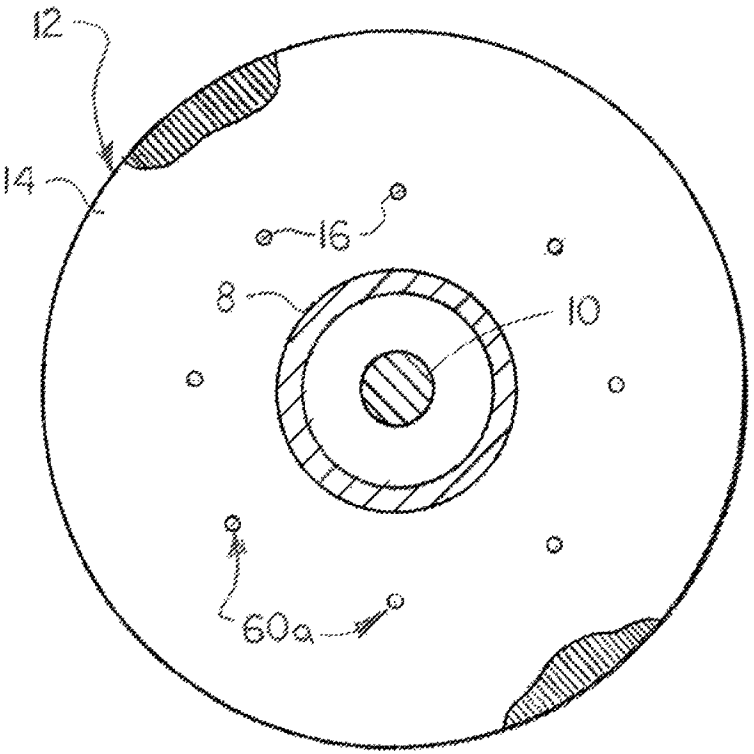
FIG. 13 is a bottom cross-sectional view, taken along section lines 13-13 in FIG. 2, with the display racks omitted from the assembly frame.
Figure 12:
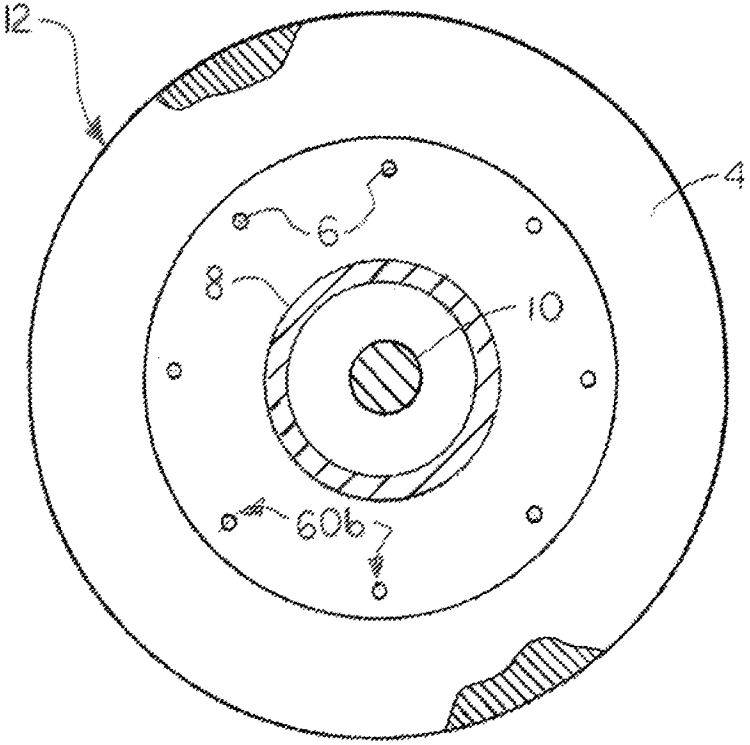
FIG. 12 is a top cross-sectional view, taken along section lines 4-4 in FIG. 2, with the display racks omitted front the assembly frame for clarity.
Figure 14:
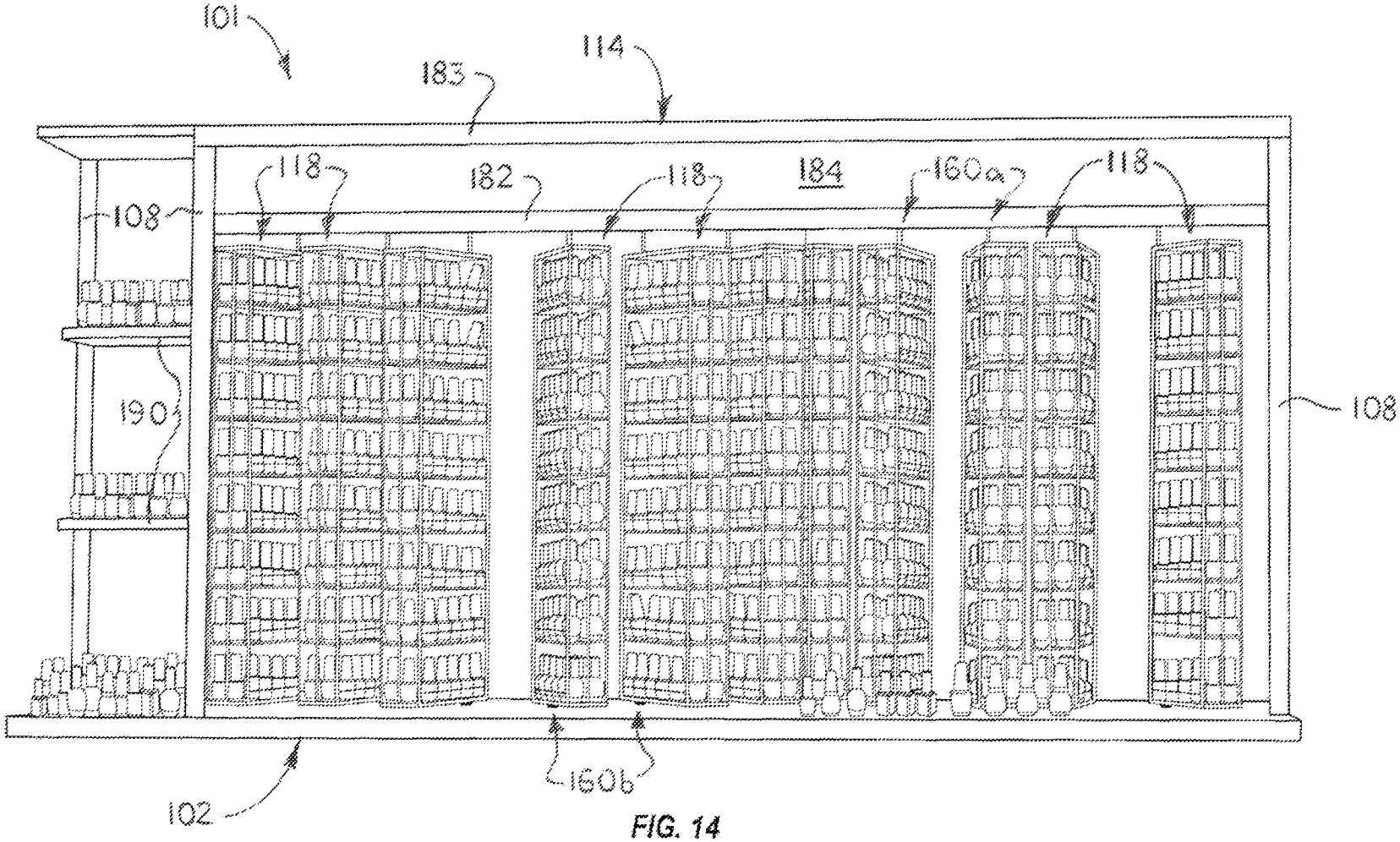
FIG. 14 is a front view of an alternative illustrative embodiment of the display rack assemblies with merchandise containers supported on display racks of the display rack assembly.

In some embodiments, the pin housing 61 of each cap rack mounting assembly 60*a* may be disposed in a corresponding cap pin housing opening 16 in the assembly cap 14 of the assembly frame 12. As illustrated in FIG. 13, the cap pin housing openings 16 may be arranged in a circle in spaced-apart relationship to each other in the assembly cap 14. As illustrated in FIGS. 8 and 9, the pin housing flange 65 on the pin housing 61 may be attached to the assembly cap 14 using housing fasteners 74, for example and without limitation. As illustrated in FIG. 10, the pin housing 61 of each base rack mounting assembly 60*b* may be disposed in a corresponding base pin housing opening 6 in the turntable 4 of the assembly base 2. As illustrated in FIG. 12, the base pin housing openings 6 may be arranged in a circle in spaced-apart relationship to each other in the turntable 4 of the assembly base 2 and in aligned or registering relationship to the respective cap pin housing openings 16 in the assembly cap 14. The pin housing flange 65 on the pin housing 61 of the base rack mounting assembly 60*b* may be attached to the turntable 4 using housing fasteners 74, for example and without limitation.

A lock pin 76 may be disposed in the pin housing interior 66 of the pin housing 61. The lock pin 76 may be positional in a locking position (FIG. 8) and a release position (FIG. 9) in the pin housing interior 66. The lock pin 76 may be biased in the locking position according to the knowledge of those skilled in the art. Accordingly, in sonic embodiments, a lock pin flange 77 may extend from the lock pin 76. A coiled pin spring 70 may be sandwiched between the pin housing end wall 63 of the pin housing 61 and the lock pin flange 77 of the lock pin 76 in the pin housing interior 66. Thus, the pin spring 70 may normally bias the lock pin 76 from the pin housing interior 66 as the pin spring 70 biases the lock pin flange 77 against the inner portion of the pin housing flange 65.

As illustrated in FIGS. 3 and 5-7, a lower mount collar 50 having a lower collar pin opening 51 may be provided on the lower surface of the lowermost rack shelf 26 of each display rack 18. An upper mount collar 54 having an upper collar pin opening 55 may be provided on the upper surface of the top rack panel 46 of each display rack 18 in aligned relationship to the lower mount collar 50. As illustrated in FIG. 7, each of the lower mount collar 50 and the upper mount collar 54 may be located between the pivot end rack panel 38*a* and a longitudinal midline 44 of the of rack 18, proximate the pivot end rack panel 38*a*.

As illustrated in FIGS. 8 and 9, a top rack pin opening 47 may extend through the top rack panel 46 of each display rack 18. The top rack pin opening 47 may align or register with the upper collar pin opening 55 in the upper mount collar 54. Accordingly, as illustrated in FIG. 8, when the upper collar pin opening 55 and the top rack pin opening 47 register with the lock pita 76 of the cap rack mounting assembly 60*a*, the pin spring 70 may bias and extend the lock pin 76 from the pin housing 61 through the upper collar pin opening 55 and underlying top rack pin opening 47 to pivotally and releasably secure the display rack 18 to the assembly cap 14 of the assembly frame 12.

As illustrated in FIG. 10, a bottom rack pin opening 32 may extend through the main shelf panel 27 of the bottortmmost rack shelf 26 in each display rack 18. The bottom rack pin opening 32 may align or register with the lower collar pin opening 51 in the lower mount collar 50. Accordingly, when the lower collar pin opening 51 and the bottom rack pin opening 32 register with the lock pin 76 of the base rack mounting assenitily 60*b*, the pin spring 70 may bias and extend the lock pin 76 from the pin housing 61 through the lower collar pin opening 51 and overlying bottom rack pin opening 32 to pivotally and releasably secure the display rack 18 to the assembly base 2 of the assembly frame 12.

As illustrated in FIG. 9, as the display rack 18 is pushed into place between the assembly base 2 and the assembly cap 14, the pin spring 70 of the cap rack mounting assembly 61*a* may initially bias its lock pin 76 against the top rack panel 46 and the upper mount collar 54 until the lock pin 76 registers with the upper collar pin opening 55 and the top rack pin opening 47, whereupon the lock pin 76 extends through the upper collar pin opening 55 and top rack pin Lint opening 47. Simultaneously and in like manner, the pin spring 70 of the base rack mounting assembly 60*h* may bias its lock pin 76 against the main shelf panel 27 of the lowermost rack shelf 26 and the lower mount collar 50 until the lock pin 76 registers with the lower collar pin opening 51 and the bottom rack pin opening 32, whereupon the lock pin 76 extends through the lower collar pin opening 51 and bottom rack pin opening 32. In some applications, each lock pin 76 may be manually grasped against the bias imparted by the pin spring 70 until the lock pin 76 aligns with the corresponding upper collar pin opening 55 and top rack pin opening 47 and lower collar pin opening 51 and bottom rack pin opening 32, and then released such that the pin spring 70 inserts the lock pin 76 through the corresponding upper collar pin opening 55 and top rack pin opening 47 and lower collar pin opening 51 and bottom rack pin opening 32.

Each display rack 18 may be selectively released from the assembly cap 14 of the assembly frame 12 by pushing the lock pin 76 of the cap rack mounting assembly 60*a* through the top rack panel pin opening 47 and registering upper collar pin opening 55 against the bias of its pin spring 70 until the lock pin 76 clears the upper collar pin opening 55. In like manner, the display rack 18 may be released from the assembly base 2 by pushing the lock pin 76 of the base rack mounting assembly 60*b* through the bottom rack pin opening 32 and registering lower collar pin opening 51 against the bias of its pin spring 70 until the lock pin 76 clears the lower collar pin opening 51. The display rack 18 may then be pulled outwardly from between the assembly base 2 and the assembly cap 14. In some embodiments, a sufficient length of the lock pin 76 may extend beyond the upper surface of the assembly cap 14 or the lower surface of the lowermost rack shelf 26 to facilitate manual gripping of the lock pin 76 against the bias imparted by the pin spring 70 until the lock pin 76 clears the corresponding top rack panel pin opening 47 and upper collar pin opening 55 of the cap rack mounting assembly 60*a* or bottom rack panel pin opening 32 and lower collar pin opening 51 of the base rack mounting assembly 60*b*. The display rack 18 may then be pulled from between the assembly cap 14 and the assembly base 2.

Figure 11:
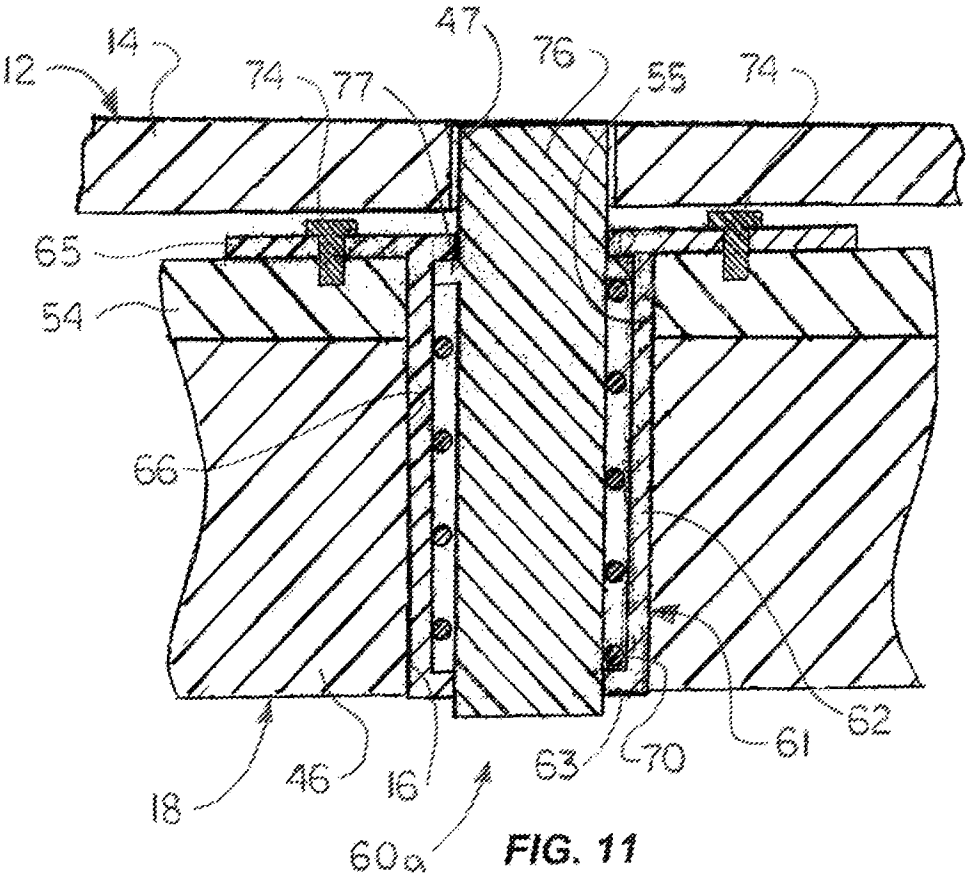
FIG. 11 is an enlarged sectional view illustrating an alternative configuration or orientation of the cap rack mounting assembly with respect to the assembly frame and each display rack.

As illustrated in FIG. 11, in some embodiments, the orientation of each cap rack mounting assembly 60*a*, as illustrated, and each base rack mounting assembly 60*b* may be reversed. Accordingly, the pin housing 61 of each cap rack mounting assembly 60*a* may be mounted in a cap pin housing opening 16 which is provided in the top rack panel 46 of the display rack 18 and may additionally be provided in the upper collar pin opening 55 in the upper mount collar 54. The top rack pin opening 47 may extend through the assembly cap 14 of the assembly frame 12. The lock pin 76 may thus extend through and retract from the top rack pin opening 47 in the assembly cap 14 in the locking and release positions, respectively, to removably secure the display rack 18 to the assembly cap 14 of the assembly frame 12. In like manner, the pin housing 61 of each base rack mounting assentbly 60*b* may be mounted in the main shelf panel 27 of the lowermost rack shelf 26 of the display rack 18. In the locking and release configurations, the lock pin 76 may respectively extend through and retract from a registering pin opening in the turntable 4 to removably secure the display rack 18 to the assembly base 2 of the assembly frame 12.

As illustrated in FIG. 1, in typical application, the display rack assembly 1 may support merchandise containers 80 which are to be viewed and accessed by customers in a retail or other establishment fir purchase or use. In some applications, the merchandise containers 80 may contain nail polish, cosmetics or the like. Accordingly, the bottom base member 3 of the assembly base 2 may be placed on a support structure 84 such as a table top or on the floor or some other surface (not illustrated), for example and without limitation. A selected number of the display racks 18 may be pivotally secured between the turntable 4 of the assembly base 2 and the assembly cap 14 of the assembly frame 12. This may be accomplished by attachment of each display rack 18 with the assembly cap 14 via engagement with the cap rack mounting assembly 60*a* and with the turntable 4 via engagement with the base rack mounting assembly 60*b*, typically as was heretofore described with respect to FIGS. 8-11. The number of display racks 18 which are placed in the assembly frame 12 may depend on the desired number of merchandise containers 80 and/or different types of the merchandise which are to be offered to the customers in the establishment.

The merchandise containers 80 may be placed on the rack shelves 26 on each display rack 18. Accordingly, multiple merchandise containers 80 may be placed on the main shelf panel 27 in adjacent relationship to each other between the pivot end rack panel 38*a* and the swing end rack panel 38*b*. The shelf flange 34 may retain and prevent the merchandise containers 80 from inadvertently falling from the main shelf panel 27 of each rack shelf 26. In some applications, the light 10 may be energized to illuminate the display racks 18 from the assembly column 8 at the center of the assembly frame 12.

A customer may access each merchandise container 80 by pivoting each display rack 18 away from one or both of the adjacent display racks 18 in the assembly frame 12 to expose the rack shelves 26 on one or both sides of the center rack panel 19 of the display rack 18. The customer may cause the display racks 18 to revolve by pushing on the display racks 18 as the turntable 4 rotates with respect to the bottom base member 3 of the assembly base 2. In some applications, the merchandise containers 81 may be categorized and organized on the rack shelves 26 and the display racks 18 according to type or color of the cosmetic or other merchandise. Labels (not illustrated) may be placed on each display rack 18 to indicate the color and/or type of cosmetic or other merchandise in the merchandise containers 80 on that rack shelf 26 or display rack 18. It will be appreciated by those skilled in the art that in some embodiments, the holding capacity of the display rack assembly 1 may be varied by releasably deploying the selected number of display racks 18 in the assembly frame 12 up to the number of base pin housing openings 6 (FIG. 12) in the turntable 4 of the assembly base 2 and cap pin housing openings 16 in the assembly cap 14.

Figure 15:
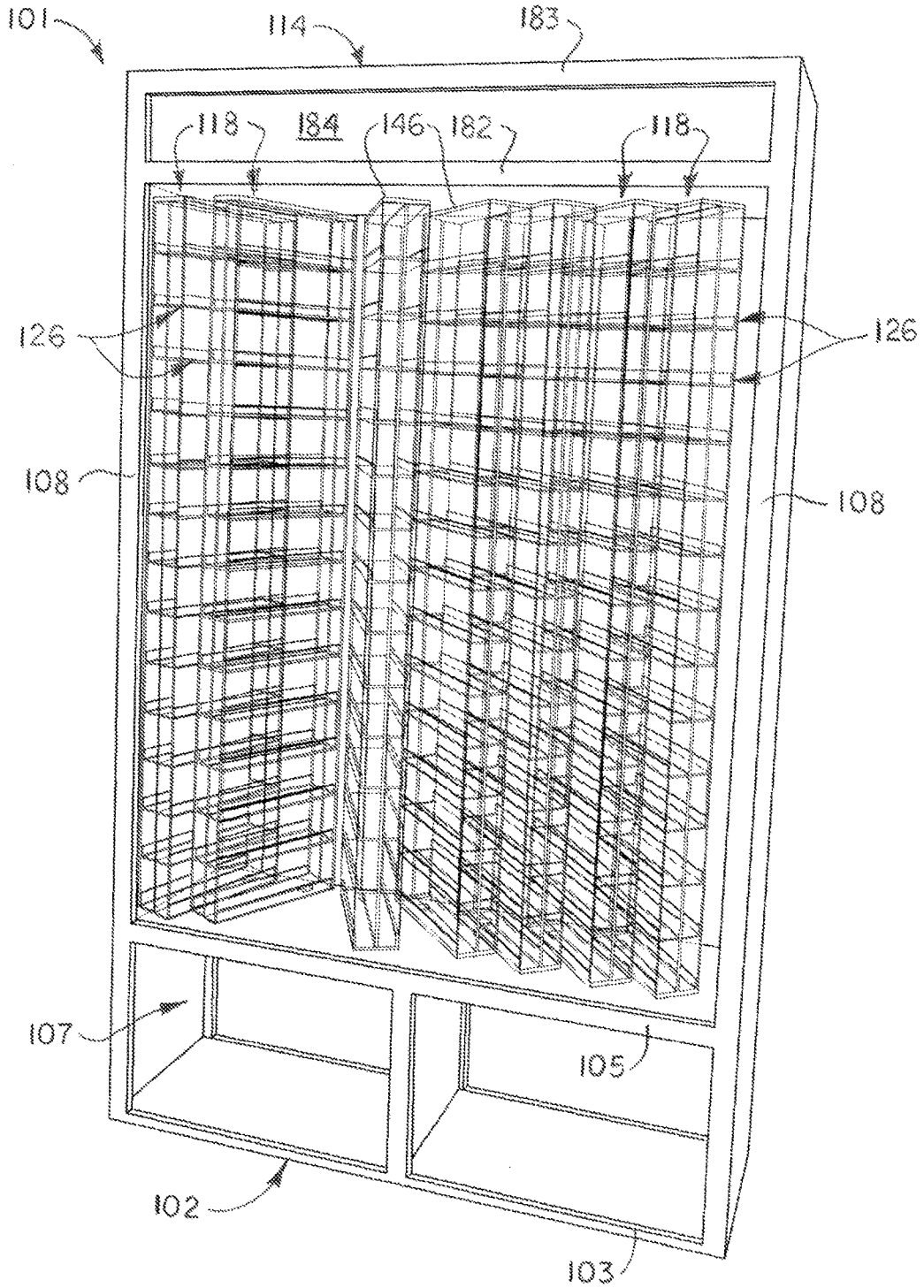
FIG. 15 is a front view of an illustrative embodiment of the display rack assembly similar to that illustrated in FIG. 14, with the merchandise containers omitted from the display racks for clarity.

Referring next to FIGS. 14-18 of the drawings, an alternative illustrative embodiment of the display rack assemblies is generally indicated by reference numeral 101. In the display rack assembly 101, elements which are analogous to the respective elements of the display rack assembly 1 that was heretofore described with respect to FIGS. 1-13 are designated by the same respective numerals in the 101-199 series in FIGS. 14-18, The assembly base 102 of the display rack assembly 101 may include at least one base member 103, 105 which may be elongated and rectangular. Multiple assembly columns 108 may extend upwardly from the assembly base 102. As illustrated in FIG. 15, in some embodiments, a top base member 105 may be supported by the assembly columns 108 above and in spaced-apart relationship to a bottom base member 103 of the assembly base 102. Accordingly, a merchandise storage space 107 may be formed by and between the bottom base member 103, the top base member 105 and the assembly columns 108. In some embodiments shelves, drawers and/or other merchandise storage or support structures (not illustrated) may be provided in the merchandise storage space 107.

Figure 16:
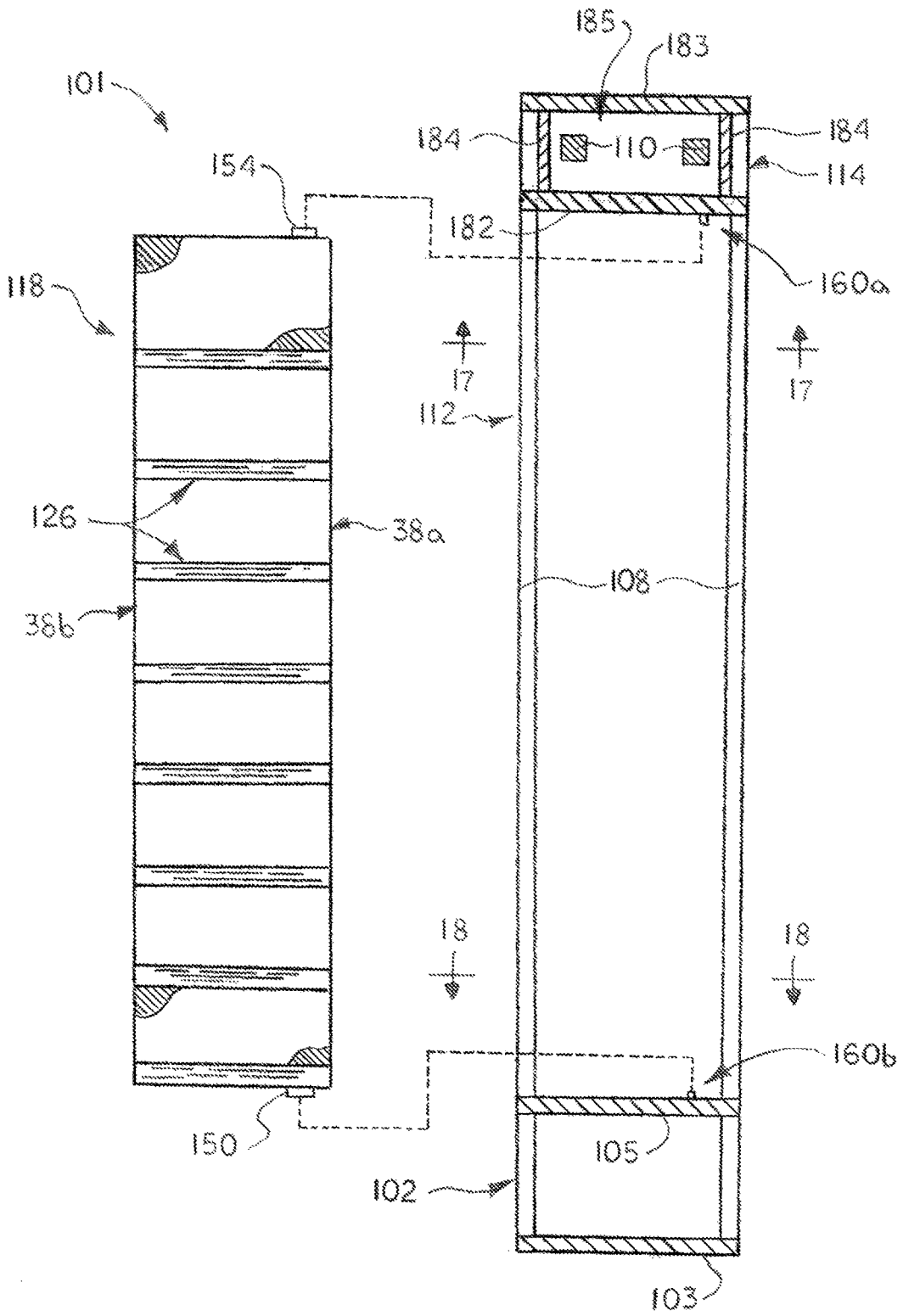
FIG. 16 is an exploded side view of the illustrative display rack assembly illustrated in FIG. 15, more particularly illustrating typical removability of each display rack with respect to the assembly frame of the display rack assembly.

The assembly cap 114 may include a lower cap member 182 supported by the assembly columns 108. An upper rap member 183 may be supported by the assembly columns 108 above and in spaced-apart relationship to the lower cap member 182. In some embodiments, at least one transparent or translucent light panel 184 may extend between the lower cap member 182 and the upper cap member 183. As illustrated in FIG. 16, at least one light 110 may be provided in the assembly cap 114. The energized light 110 may illuminate through the light panel or panels 184. The name or brand of merchandise which is contained in the merchandise containers 180 supported by the display rack assembly 101 may be provided on the light or light panels 184.

Figure 17:
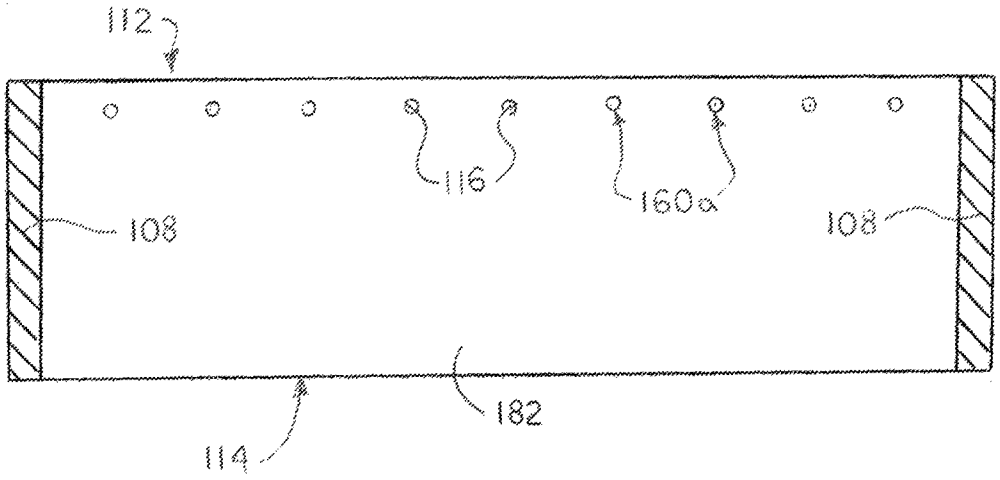
FIG. 17 is a bottom cross-sectional view, taken along section lines 17-17 in FIG. 16, with the display racks omitted from the assembly frame for clarity.
Figure 18:
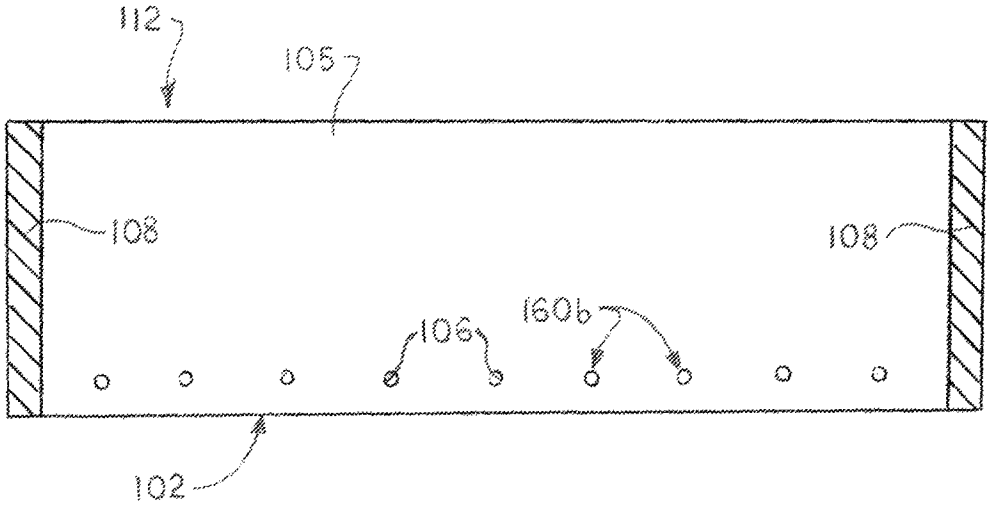
FIG. 18 is a top cross-sectional view, taken along section lines 18-18 in FIG. 16, with the display racks omitted from the assembly frame.

As illustrated in FIG. 17, multiple cap rack locking assemblies 160*a* may be provided in spaced-apart relationship with respect to each other along the lower cap member 182 of the assembly cap 114. As illustrated in FIG. 18, in like manner, multiple base rack locking assemblies 160*b* may be provided in spaced-apart relationship with respect to each other along the upper base member 105 of the assembly base 102 and in aligned or registering relationship to the respective cap rack locking assemblies 160*a*.

Application of the display rack assembly 101 may be as was heretofore described with respect to the display rack assembly 1 in FIGS. 1-13. Accordingly, a selected number of the display racks 118 may be pivotally secured between the top base member 105 of the assembly base 102 and the lower cap member 182 of the assembly cap 114 on the assembly frame 112 in parallel. adjacent relationship to each other. This may be accomplished by attachment of each display rack 118 with the assembly cap 114 via engagement with the eap rack mounting assembly 160*a* on the lower cap member 182 and with the assembly base 102 via engagement with the base rack mounting assembly 160*b* on the top base member 105. Multiple merchandise containers 108 may be placed on each rack shelf 126 on each display rack 118. Customers may access the merchandise containers 108 for purchase or use by individually rotating or pivoting each display rack 118 to expose the merchandise containers 108 on the rack shelves 126 on each side of the center rack panel 119 of each display rack 118. Display racks 118 may be individually added to or removed from the assembly frame 112 depending on the desired holding capacity for the merchandise containers 180.

While certain illustrative embodiments of the disclosure have been, described above, it will be recognized and understood that various modifications can he made to the embodiments and the appended claims are intended to cover all such modifications which may fall within the spirit and scope of the disclosure.

I claim:

1. A display rack assembly, comprising:

an assembly frame including:

an assembly base; and an assembly cap carried by the assembly base; and at least one display rack releasably and pivotally deployed between the assembly base and the assembly cap of the assembly frame, the at least one display rack having an elongated rectangular, box-shaped configuration and including:

a pivot end rack panel;

a swing end rack panel disposed in parallel, spaced-apart relationship to the pivot end rack panel;

each of the pivot end rack panel and the swing endl rack panel is elongated, continuous and rectangular;

an elongated, continuous and rectangular center rack panel extending between the pivot end rack panel and the swing end rack panel;

a plurality of rack shelves extending between the pivot end rack panel and the swing end rack panel on respective sides of the center rack panel and in parallel, spaced-apart relationship to each ether;

the rack shelves facing outwardly in opposite directions from the center rack panel, each rack shelf having a rectangular and planar main shelf panel; and an elongated and continuous shelf flange extending from and coextensive with each main shelf panel, the shelf flange disposed in perpendicular relationship to a plane of the main shelf panel and in parallel relationship to a plane of the center rack panel.

2. The display rack assembly of claim 1 further comprising at least one assembly column extending between the assembly base and the assembly cap of the assembly frame.

3. The display rack assembly of claim 1 wherein the assembly base and the assembly cap are elongated and parallel to each other, and the at least one display rack comprises a plurality of display racks extending between the assembly base and the assembly cap in parallel, adjacent relationship to each other.

4. The display rack assembly of claim 1 wherein the assembly base comprises a bottom base member and a turntable carried by the bottom base member, and the assembly cap is carried by the turntable.

5. The display rack assembly ofclaim 1 further comprising at least one rack mounting assembly releasably securing the at least one display rack to at least one of the assembly base and the assembly cap of the assembly frame.

6. The display rack assembly of claim 5 wherein the at least one rack mounting assembly comprises at least one cap rack mounting assembly carried by the assembly cap and releasably securing the at least one display rack to the assembly cap and at least one base rack locking assembly carried by the assembly base and releasably securing the at least one display rack to the assembly base.

7. The display rack assembly of claim 5 wherein the at least one rack mounting assembly comprises a pin housing carried by a first one of the assembly frame and the at least one display rack, a lock pin disposed between locking and release positions in the pin housing, a pin spring in the pin housing and biasing the lock pin in the locking position and at least one pin opening in a second one of the assembly frame and the at least one display rack, the lock pin inserts in the at least one pin opening in the locking position of the lock, pin.

8. The display rack assembly of claim 7 further comprising at least one pin housing opening in the first one of the assembly frame and the at least one display rack, and wherein the pin housing is disposed in the at least one pin housing opening.

9. A display rack assembly, comprising:

an assembly frame including:

an assembly base; and an assembly cap carried by the assembly base;

at least one elongated, rectangular, box-shaped display rack releasably and pivotally deployed between the assembly base and the assembly cap of the assembly frame, the at least one display rack having;

a pivot end rack panel;

a swing end rack panel panel disposed in parallel, spaced-apart relationship to the pivot end rack panel;

each of the pivot end rack panel and the swing end rack panel is elongated, continuous and rectangular with a pair of elongated, parallel, spaced-apart side end panel edges and a lower end panel edge and an upper end panel edge extending between the side end panel edges;

an elongated, continuous and rectangular center rack panel extending between the pivot end rack panel and the swing end rack panel, the center rack panel having a pair of elongated, parallel, spaced-apart side rack panel edges, a bottom rack panel edge and a top rack panel edge extending between the side rack panel edges, the end rack panels disposed in perpendicular relationship to and engaging the side rack panel edges, respectively, of the center rack panel;

a top rack panel extending over the upper end panel edges of the pivot end rack panel and the swing end rack panel, respectively, and the top rack panel edge of the center rack panel, the top rack panel closes the upper end of the display rack;

a first plurality of rack shelves extending between the pivot end rack panel and the swing end rack panels panel on a first side of the center rack panel; and a second plurality of rack shelves extending between the pivot end rack panel and the swing end rack panel on a second side of the center rack panel;

the first plurality of rack shelves are disposed in parallel, spaced-apart relationship with respect to each other and the second plurality of rack shelves are disposed in parallel, spaced-apart relationship with respect to each other from the lower end panel edges to the upper end panel edges of the pivot end rack panel and the swing end rack panel and from the bottom rack panel edge to the top rack panel edge of the center rack panel;

the rack shelves facing outwardly in opposite directions from the center rack panel;

each rack shelf having a rectangular and planar main shelf panel, each main shelf panel including:

a proximal shelf panel edge extending along a corresponding surface of the center rack panel;

a distal shelf panel edge extending in parallel, spaced-apart relationship to the proximal shelf panel edge;

a pair of parallel, spaced-apart side panel edges extending from the proximal shelf panel edge to the distal shelf panel edge, the side shelf panel edges extending along interior surfaces of the pivot end rack panel and the swing end rack panel, respectively, the distal shelf panel edge of each main shelf panel terminating in flush relationship to a corresponding side end panel edge of each corresponding end rack panel on a corresponding side of the center rack panel; and an elongated and continuous shelf flange terminating the distal shelf panel flange of each main shelf panel, the shelf flange coextensive with the main shelf panel and disposed in perpendicular relationship to a plane of the main shelf panel and in parallel relationship to a plane of the center rack panel; and at least one rack mounting assembly releasably securing the at least one display rack, to at least one of the assembly base and the assembly cap of the assembly frame.

10. The display rack assembly of claim 9 further comprising at least one assembly column extending between the assembly base and the assembly cap of the assembly frame.

11. The display rack assembly of claim 9 further comprising at least one light carried by the assembly frame.

12. The display rack assembly of claim 9 wherein the assembly base comprises a bottom base member and, a turntable carried by the bottom base member, and the assembly cap is carried by the turntable.

13. The display rack assembly of claim 9 wherein the at least one rack mounting assembly comprises a pin housing carried by a first one of the assembly frame and the at least one display rack, a lock pin disposed between locking and release positions in the pin housing, a pin spring in the pin housing and biasing the lock pin in the locking position and at least one pin opening in a second one of the assembly frame and the at least one display rack, the lock pin inserts in the at least one pin opening in the locking position of the lock pin.

14. The display rack assembly of claim 13 further comprising at least one pin housing opening in the first one of the assembly frame and the at least one display rack, and wherein the pin housing is disposed in the at least one pin housing opening.

15. The display rack assembly of claim 9 wherein the at least one rack mounting assembly comprises a pin housing carried by the display rack, a lock pin disposed between locking and release positions in the pin housing, a pin spring in the pin housing and biasing the lock pin in the locking position and at least one pin opening in the assembly frame, the lock pin inserts in the at least one pin opening in the locking position of the lock pin.

16. A display rack assembly, comprising:

an assembly frame including:

an assembly base;

at least one assembly column upward-standing from the assembly bases; and an assembly cap carried by the at least one assembly column;

a plurality of elongated, rectangular, box-shaped display racks releasably and pivotally deployed between the assembly base and the assembly cap of the assembly frame, each of the plurality of display racks having:

a pivot end rack panel;

a swing end rack panel disposed in parallel, spaced-apart relationship to the pivot end rack panel;

each of the pivot end rack panel and the swing end rack panel is elongated, continuous and rectangular with a pair of elongated, parallel, spaced-apart side end panel edges and a lower end panel edge and an upper end panel edge extending between the side end panel edges;

ar elongated, continuous and rectangular center rack panel extending between the pivot end rack panel and the swing end rack panel, the center rack panel having a pair of elongated, parallel, spaced-apart side rack panel edges, a bottom rack panel edge and a top rack panel edge extending between the side rack panel edges, the pivot end rack panel and the swing end rack panel disposed ipperpendicular relationship to and engaging the side rack panel edges, respectively, of the center rack panel;

a top rack panel extending over the upper end panel edges of the pivot end rack panel and the swing end rack panel, respectively, and the top rack panel edge of the center rack panel, the top rack panel closes the upper end of the display rack;

a first plurality of rack shelves extending between the pivot end rack panel and the swing end rack panel on a first side of the center rack panel;

a second plurality of rack shelves extending between the pivot end rack panel and the swing end rack panel on a second side of the center rack panel;

the first plurality of rack shelves are disposed in parallel, spaced-apart relationship to each other and the second plurality of rack shelves are disposed in parallel, spaced-apart relationship to each other from the lower end panel edges to the upper end panel edges of the pivot end rack panel and the swing end rack panel and from the bottom rack panel edge to the top rack panel edge of the center rack panel; and the first plurality of rack shelves and the second plurality of rack shelves facing outwardly in opposite directions from the center rack panel, each of the first plurality of rack shelves and the second plurality of rack shelves having:

a rectangular and planar main shelf panel, each main shelf panel including:

a proximal shelf panel edge extending along a corresponding surface of the center rack panel;

a distal shelf panel edge extending in parallel, spaced-apart relationship to the proximal shelf panel edge;

a pair of parallel, spaced-apart shelf panel edges extending from the proximal shelf panel edge to the distal shelf panel edge, the side shelf panel edges extending along interior surfaces of the pivot end rack panel and the swing end rack panel, respectively, the distal shelf panel edge of each main shelf panel terminating in flush relationship to a corresponding side end panel edge of each corresponding end rack panel on a corresponding side of the center rack panel; and an elongated and continuous shelf flange terminating the distal shelf panel edge of each main shelf panel, the shelf panel edge coextensive with the main shelf panel and disposed in perpendicular relationship to a plane of the main shelf panel and in parallel relationship to a plane of the center rack panel;

a first plurality of rack mounting assemblies releasably securing the plurality of display racks to the assembly cap of the assembly frame, each of the first plurality of rack mounting assemblies including:

a first plurality of pin housing openings in a first one of the assembly cap and the plurality of display racks, respectively;

a first pin housing disposed in each corresponding one of the first plurality of pin housing openings;

a first lock pin disposed between locking and release positions in the first pin housing;

a first pin spring in the first pin housing and biasing the first lock pin in the locking position; and a first plurality of pin openings in a second one of the assembly cap and the plurality of display racks, respectively, the first lock pin of each of the first plurality of rack mounting assemblies inserts in a corresponding one of the first plurality of pin openings in the locking position of the first lock pin; and a second plurality of rack mounting assemblies releasably securing the plurality of display racks to the assembly base of the assembly frame, each of the second plurality of rack mounting assemblies including:

a second plurality of pin housing openings in a second one of the assembly base and the plurality of display racks, respectively;

a second pin housing, disposed in each corresponding one of the second plurality of pin housing, openings;

a second lock pin disposed between locking and release positions in the second pin housing; and a second pin spring in the second pin housing and biasing the second lock pin in the locking position; and a second plurality of pin openings in a second one of the assembly base and the plurality of display racks, respectively, the second lock pin of each of the second plurality of rack mounting assemblies inserts in a corresponding one of the second plurality of pin openings in the locking position of the second lock pin.

17. The display rack assembly of claim 16 wherein the assembly base comprises a bottom base member and a turntable carried by the bottom base member, and the at least one assembly column extends between the turntable, and the assembly cap.

18. The display rack assembly of claim 16 wherein the assembly base and the assembly cap are elongated and parallel to each other, and the plurality of display racks are disposed in parallel, adjacent relationship to each other between the assembly base and the assembly cap.

19. The display rack assembly of claim 16 further comprising at least one light carried by the assembly frame.

* * * * *